United States Patent [19]

Bovenlander

[11] 4,092,585

[45] May 30, 1978

[54] APPARATUS FOR MEASURING ENGINE TIMING INDEPENDENT OF SPEED

[75] Inventor: Johannes P. Bovenlander, Kormmenie, Netherlands

[73] Assignee: Sun Electric Corporation, Chicago, Ill.

[21] Appl. No.: 682,381

[22] Filed: May 3, 1976

[51] Int. Cl.[2] ..... F02P 17/00

[52] U.S. Cl. ..... 324/16 T

[58] Field of Search ..... 324/16 T, 15; 73/118

[56] References Cited

U.S. PATENT DOCUMENTS

| | | | |
|---|---|---|---|
| 2,785,215 | 3/1957 | Yetter | 324/16 T |
| 3,314,407 | 4/1967 | Schneider | 324/16 T |
| 3,368,143 | 2/1968 | Roberts et al. | 324/16 T |
| 3,597,677 | 8/1971 | MacCrea et al. | 324/16 T |
| 3,813,931 | 6/1974 | Rennick et al. | 324/16 T X |

FOREIGN PATENT DOCUMENTS

| | | | |
|---|---|---|---|
| 1,159,473 | 7/1969 | United Kingdom | 324/16 T |

*Primary Examiner*—Stanley T. Krawczewicz
*Attorney, Agent, or Firm*—Allegretti, Newitt, Witcoff & McAndrews

[57] ABSTRACT

The disclosure describes improved apparatus for creating a delay for stroboscopes which corresponds to a fixed rotational angle of an engine and is independent of the rotational speed of the engine. The delay is created by charging a capacitor by means of a first current source and discharging the capacitor by means of a second current source.

5 Claims, 8 Drawing Figures

Fig. 1
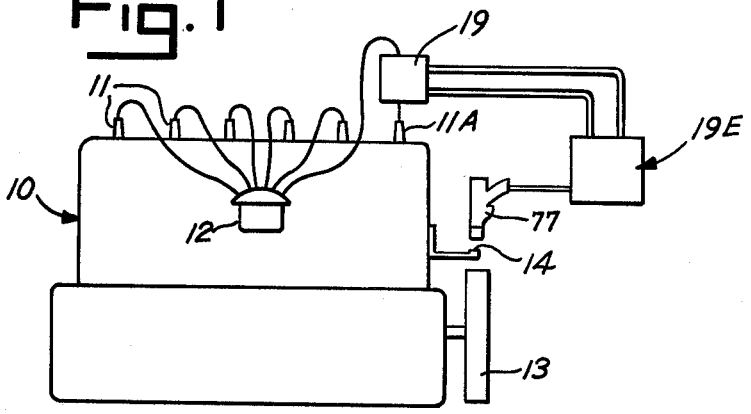
Fig. 2A
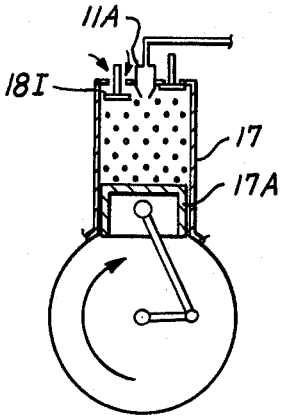
INTAKE
Fig. 2B
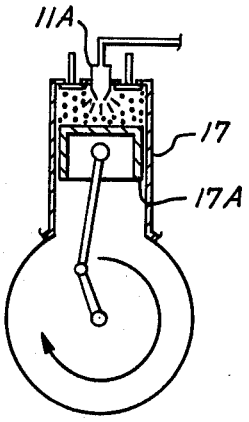
COMPRESSION & SPARK
Fig. 2C
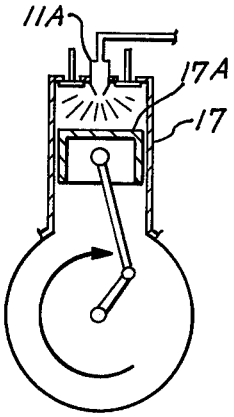
POWER
Fig. 2D
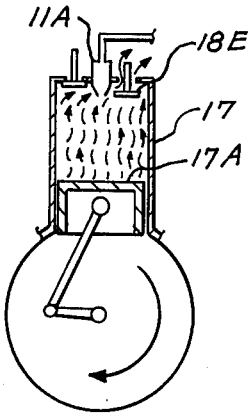
EXHAUST
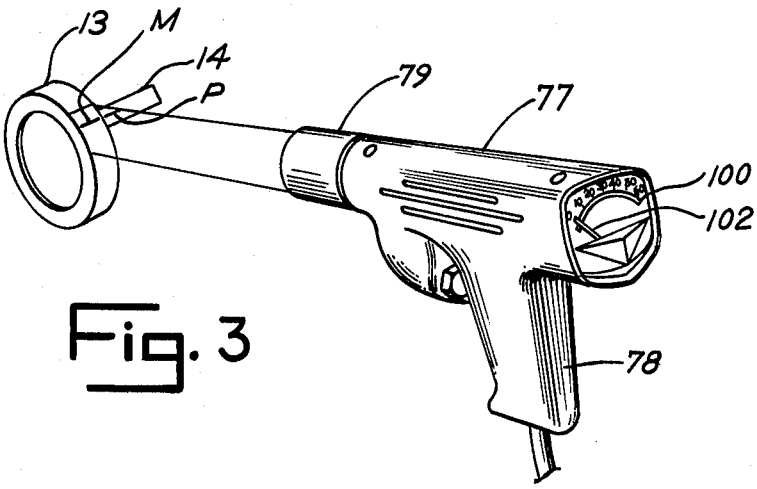
Fig. 3

APPARATUS FOR MEASURING ENGINE TIMING INDEPENDENT OF SPEED

BACKGROUND AND SUMMARY OF THE INVENTION

This invention relates to timing advance measuring devices, and more particularly relates to stroboscopes used to measure the timing advance of an internal combustion engine.

Many types of internal combustion engines include chambers in which members are movable. For example, gasoline engines typically include a number of cylinders in which pistons move up and down. A gas-air mixture is introduced into the cylinders, and the mixture is compressed by the upstroke of the piston in the cylinder. Just prior to the time the piston reaches the top of its stroke in the cylinder (known as the top dead center position), a spark plug ignites the gas-air mixture in order to drive the piston down.

In order to properly tune such an engine, it is important to know very precisely the number of rotational degrees prior to the top dead center position at which the spark plug fires (i.e., the spark advance of the engine). One conventional way of measuring the spark advance is by use of a stroboscope which flashes within a controllable delay period after the spark plug fires. In normal use, the flash is delayed until the moment at which the piston is in its top dead center position. This position is normally indicated by the alignment of two marks, one located on the fly wheel or pulley of the engine, and the other on the crankcase of the engine. If the stroboscope flashes at the time the two marks are aligned, then the delay between the time the spark plug fires and the time the stroboscope flashes represents the measured spark advance, which is normally expressed in degrees. One such stroboscope device is described in U.S. Pat. No. 3,368,143 (Roberts et al. - Feb. 6, 1968).

In prior art devices, the spark advance is displayed in terms of mechanical degrees that are measured by an adjustable delay time period. As a result, the spark advance degree indication is only accurate as long as the engine is held at a constant speed. If the speed is varied, the indication given by the stroboscope delay time period inaccurately describes the spark advance in terms of mechanical engine position or degrees.

In order to overcome the deficiency of the prior art stroboscope devices, the applicant has invented a technique for flashing the stroboscope which is independent of the speed of the engine. By using this technique, the speed of the engine can vary over a considerable range without affecting the accuracy of the spark advance degrees indicated by the stroboscope.

In order to achieve this result, the applicant utilizes a lamp which illuminates the indicia on the engine in response to a strobe signal. A trigger signal is generated in response to the operation of a combustion means, such as a spark plug, which creates the combustion of the fuel in the engine. Means are provided for storing a variable timing voltage, and a reference voltage is generated. A control device responsive to each trigger signal alters the timing voltage in a first direction at a first predetermined rate so that the timing voltage attains a predetermined relationship with respect to the reference voltage. The control device also generates a strobe signal each time the timing voltage attains the predetermined relationship with respect to the reference voltage in order to flash the lamp.

When the lamp flashes, the control device begins to alter the timing voltage in a second direction opposite the first direction at a second predetermined rate. This second alteration of timing voltage continues until the next trigger signal is generated, such as by the firing of the spark plug. Means are provided for altering the rate at which the timing voltage changes in the first direction. As a result, the flash on the lamp can be adjusted in time until the indicia marks on the engine appear to be lined up. A scale is connected to the adjustment means for displaying the degree of movement of the engine in order to indicate the retard or advance of the timing.

By using the foregoing techniques, the timing of an engine can be measured with a degree of accuracy and reliability heretofore unattainable.

DESCRIPTION OF THE DRAWINGS

These and other advantages and features of the present invention will hereafter appear in connection with the accompanying drawings wherein like numbers refer to like parts throughout and wherein:

FIG. 1 is a schematic illustration of an exemplary internal combustion engine which may be used in connection with the present invention;

FIGS. 2A–2D are fragmentary, schematic drawings illustrating the operation of an exemplary engine;

FIG. 3 is a perspective view of a preferred form of stroboscope and scale made in accordance with the present invention;

DESCRIPTION OF THE PREFERRED EMBODIMENT

Figure 4:
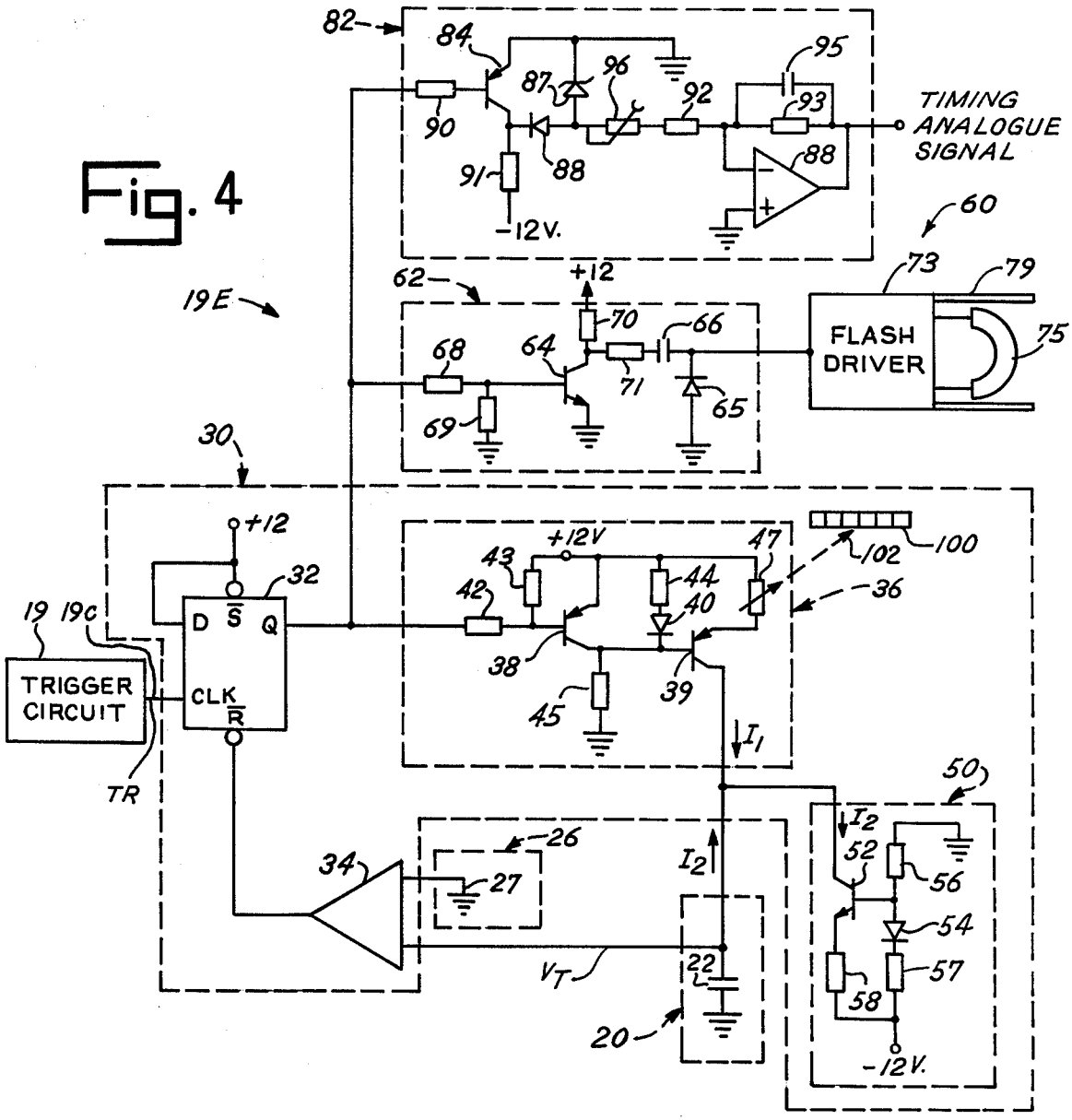
FIG. 4 is an electrical schematic diagram illustrating a preferred form of electrical circuitry made in accordance with the present invention.

Referring to FIG. 1, a preferred embodiment of the present invention may be used in connection with any conventional internal combustion engine, such as a gasoline engine 10, which is provided with a plurality of combustion devices, such as spark plugs 11, whose firing is sequentially controlled by a distributor 12. A spark plug 11A is fitted in the number 1 cylinder of the engine 17 which holds the number 1 piston 17A (FIG. 2A).

Engine 10 includes six chambers, such as cylinders. Each of the chambers is fitted with a member movable in the chamber, such as a piston. However, the chamber could be of a non-cylindrical shape, and the member could be a rotating member, rather than a piston, such as in a Wankel engine.

The engine is provided with a rotating part 13, such as a fly wheel or damper, which bears a reference mark M and with a fixed reference, such as a pointer 14, carried by a fixed part of the engine which bears a mark P. The alignment of marks M and P indicates when one of the pistons, for example, the number 1 piston, is moved to the top dead center position.

The engine may be equipped with the usual automatic timing advance which will cause the spark plugs to fire at varying times in advance of the top dead center positions of the pistons, and one purpose of the engine is to accurately determine the amount of this advance.

FIGS. 2A–2D illustrate a typical operating cycle of cylinder 17A. In FIG. 2A, an air-fuel mixture is drawn into the cylinder through an intake valve 18I as piston 17A is moving downward. The air-fuel mixture is compressed by the upward movement of the piston until spark plug 11A fires at the position of the piston shown in FIG. 2B (e.g., 6° before the top dead center position). The fuel-air mixture then explodes and the piston is driven down as shown in FIG. 2C. Exhaust valve 18E then opens and the exhaust gases are expelled as the piston moves upward (FIG. 2D).

If engine 10 were a diesel engine, spark plugs 11 would be replaced by fuel injectors which would provide a combustion means for creating the combustion of fuel in the cylinders. As the piston moves upward to the position shown in FIG. 2B, the injector squirts a charge of fuel into the cylinder. The heat of the compressed air causes the fuel to explode and drives the piston down (FIG. 2C).

A preferred form of timing advance apparatus made in accordance with the present invention useful in connection with engine 10 basically comprises a trigger circuit 19, an electronic unit 19E including a storage device 20, a source of reference voltage 26, a control circuit 30, a lamp circuit 60, an analog circuit 82, and a scale 100.

As shown in FIGS. 1 and 4, trigger circuit 19 converts the surge of firing current in the lead of the number one spark plug into an appropriate trigger signal. Trigger circuits of the foregoing type are well known in the art, and one such circuit is described in U.S. Pat. No. 3,368,143. Alternatively, if the preferred embodiment of the invention is used in connection with a diesel engine, the trigger circuit would comprise a device for producing a trigger signal when the pressure wave in the fuel injector indicates that fuel is being admitted to the number one cylinder. The trigger signal is transmitted to control circuit 30 over a conductor 19C.

Storage device 20 comprises a conventional capacitor 22 which is used to store a variable timing voltage VT.

Source 26 may be any common source of a reference voltage. In a case of the preferred embodiment, the source is a ground connection 27.

Control circuit 30 basically comprises a flip flop 32, a comparator 34, and current sources 36 and 50:

Flip flop 32 is a conventional bi-stable device which causes its Q output to switch to the same voltage state as its D input in response to the receipt of each trigger signal. For example, if the D input is in its one state, the Q output is switched to its one state in response to the receipt of a trigger signal at its CLK input. The Q output reverts to its 0 state in response to the receipt of a reset signal at the reset or R input.

Comparator 34 is a conventional device which produces a reset pulse when voltage VT equals the voltage of source 26 (e.g., 0 volts).

Current source 36 comprises transistors 38, 39, a diode 40, resistors 42–45 and a potentiometer 47. The potentiometer is adjustable by the operator of the device in order to change the time at which the lamp flashes. Current source 50 comprises a transistor 52, a diode 54 and resistors 56–58.

Lamp circuit 60 comprises a strobe generator circuit 62, a flash driver 73 and a lamp 75.

Strobe generator circuit 62 comprises a transistor 64, a diode 65, a capacitor 66 and resistors 68–71. Circuit 62 generates a strobe pulse each time the Q output of flip flop 32 is switched from its 1 to 0 state.

Flash driver 73 comprises a conventional circuit for illuminating a lamp 75 in response to each strobe pulse. Such flash drivers are well known in the art, and one exemplary circuit is shown in the above-identified U.S. Pat. No. 3,368,143. As shown in FIG. 3 and 4, lamp 75 is held in a case 77 which includes a handle 78 for the operator to grip. The light is directed to the engine by light shield 79.

Analog circuit 82 comprises a transistor 84, a zender diode 87, a switching diode 88, an operational amplifier 88, resistors 90–93, a capacitor 95 and an adjustable potentiometer 96. Analog circuit 82 produces a DC voltage which is proportional to the engine advance timing in degrees.

Referring to FIGS. 3 and 4, scale 100 is built into case 77. The scale includes a pointer 102 that is connected to the movable arm of potentiometer 47. As the potentiometer is varied, the indication by pointer 102 on scale 100 also varies. In the preferred embodiment, scale 100 reads in degrees of engine advance or retard.

The preferred embodiment of the invention operates as follows:

Assuming the number one spark plug 11A is fired at time *t*0 (FIG. 5), a trigger signal TR1 is created by trigger circuit 19 which sets the Q output of flip flop 32 to its 1 state at time *t*0. At time *t*0, the timing voltage (VT) across capacitor 22 is at a low value VL. However, as soon as the Q output of flip flop 32 is switched to its one state, current source 36 switches on and begins to charge capacitor 22 with current I1 which flows in the direction from transistor 39 through capacitor 22 to ground potential. Since current source 50 is always turned on and always generates a current 12 which flows through capacitor 22 in a direction opposite current I1, the actual current charging capacitor 22 is I1–I2. However, the resistor values of current sources 36 and 50 are arranged so that current I1 is substantially greater in value than current I2. As a result, from *t*0 to time *t*1, timing voltage VT across capacitor 22 increases in the manner shown in FIG. 5.

At time *t*1, when voltage VT equals the reference voltage of source 26, comparator 34 produces a reset pulse which resets the Q output of flip flop 32 to its 0 state. The 1 to 0 state transition of flip flop 32 turns off current source 36 and causes strobe generator 62 to generate a strobe pulse ST1 which causes lamp 75 to flash.

From time *t*1 to *t*2, capacitor 22 is discharged by current I2 produced by current source 50. Capacitor 22 continues to discharge until the next trigger pulse TR2 is received from trigger circuit 19 during the next firing of spark plug 11A.

By varying the value of potentiometer 47, the operator can vary the value of current I1 and the rate at which the voltage VT changes while capacitor 22 is charging. This change varies the time at which lamp 75 is flashed. Normally, potentiometer 47 is adjusted until the lamp flashes while marks M and P are aligned.

Figure 5:
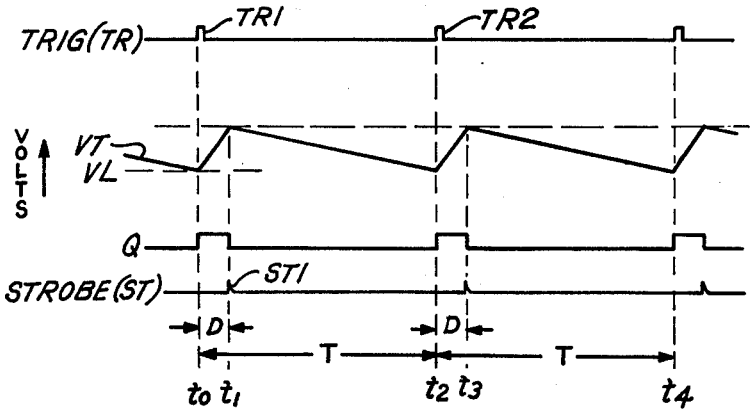
FIG. 5 is a timing diagram illustrating the voltages produced at various portions of the circuitry shown in FIG. 4.

Referring to FIG. 5, the delay time period from *t*0 to *t*1 can be defined as period D and the time between trigger signals TR1 and TR2 (between time *t*0 and *t*2) can be defined as period T. Based on this information, it can be demonstrated that the ratio of D to T depends only on the ratios of the values of currents I1 and I2, and is independent of the speed of the engine being tested.

Referring to FIG. 5, it can be seen that the voltage increase while capacitor 22 is charging (during time period D) is equal to the voltage decrease while capacitor 22 is discharging (during time period T−D). If C1 equals the value of capacitor 22 in microfarads, the voltage during the charging period of time equals $(I1 - I2)D,/C1$ whereas the voltage during the discharge period of time equals $I2/C1\ (T-D)$. Since these two voltages are equal, $(I1 - I2)/C1\ D = I2/C1\ (T-D)$. Solving this equation results in $D/T = I2/I1$.

As a result, the flashing of lamp 75 is automatically adjusted to be independent of engine speed. When the operator adjusts potentiometer 47 in order to vary the amount of current I1 until the lamp illuminates at the same time marks M and P are aligned, the marks will continue to appear to be aligned even though the engine speed changes. The marks will continue to appear to be aligned with changes in engine speed even though the value of potentiometer 47 is not changed by the operator.

For example, if the engine slows down, the delay period D is lengthened in order to flash lamp 75 at the time marks M and P are aligned. If the engine slows down, capacitor 22 discharges for a longer period of time between trigger signals and voltage level VT is lower than level VL illustrated in FIG. 5. Capacitor 22 then requires a longer period of time to charge to the reference level of source 26, and the delay period D is increased in time accordingly. As a result, even though the engine slows down, marks M and P are still aligned at the lamp 75 is illuminated. The apparatus works in the converse fashion if the engine speed increases so that marks M and P continue to be aligned when lamp 75 flashes even though the setting of potentiometer 47 is not changed.

When potentiometer 47 is adjusted so that marks M and P are aligned when lamp 75 is flashed, pointer 102 indicates the degrees of engine timing advance or retard on scale 100.

Those skilled in the art will recognize that only a single embodiment of the invention has been described, and that the embodiment may be altered and modified without departing from the true spirit and scope of the invention as defined in the appended claims.

What is claimed is:

1. Engine timing measuring apparatus for an engine having a chamber, a member movable in the chamber, combustion means for creating the combustion of fuel in the chamber so that the member is driven with respect to the chamber and an indicia to indicate the relative position of the chamber and the member, said apparatus comprising:

lamp means for illuminating the indicia in response to a strobe signal;

trigger means for generating a trigger signal in response to the operation of the combustion means to create the combustion of fuel in the chamber;

means for storing a variable timing voltage;

reference means for generating a reference voltage, said reference voltage being fixed during normal operation;

control means responsive to each trigger signal for altering the timing voltage in a first direction at a first predetermined rate until the timing voltage attains a predetermined relationship with respect to the reference voltage, for generating a strobe signal each time the timing voltage attains the predetermined relationship with respect to the reference voltage, and for altering the timing voltage in a second direction opposite the first direction at a second predetermined rate from the time the timing voltage attains the predetermined relationship with respect to the reference voltage until the next trigger signal is generated;

adjustment means for altering the first predetermined rate until the lamp means illuminates the indicia in a predetermined position; and scale means connected to the adjustment means for displaying the degree of movement of the member relative to the chamber between the time the trigger signal is generated and the time the lamp means is illuminated, whereby the degree of movement is accurately displayed irrespective of changes in speed of the member relative to the chamber.

2. Apparatus, as claimed in claim 1, wherein the means for storing comprises a capacitor.

3. Apparatus, as claimed in claim 2, wherein the control means comprises:

a first current source for altering the timing voltage in the first direction; and a second current source for altering the timing voltage in the second direction.

4. Apparatus, as claimed in claim 3, wherein the control means further comprises:

comparator means for generating a reset pulse when the timing voltage attains the predetermined relationship with respect to the reference voltage;

flip flop means for producing an output signal which switches to a first state in response to each trigger signal and switches to a second state in response to each reset pulse; and generating means for generating the strobe signal each time the flip flop means output signal changes from the first state to the second state.

5. Apparatus, as claimed in claim 3, wherein the adjustment means comprises a potentiometer connected to the first current source.

* * * * *